United States Patent [19]

Gilham et al.

[11] Patent Number: 4,813,802

[45] Date of Patent: Mar. 21, 1989

[54] DEVICE FOR VERIFYING IF THERMAL PRINTER IS OPERATING CORRECTLY

[75] Inventors: Dennis T. Gilham, Ongar; Raymond J. Herbert, Leigh-on-Sea, both of United Kingdom

[73] Assignee: Alcatel Business Systems Ltd., Romford, United Kingdom

[21] Appl. No.: 92,546

[22] Filed: Sep. 3, 1987

[30] Foreign Application Priority Data

Sep. 4, 1986 [GB] United Kingdom ..... 8621335

[51] Int. Cl.[4] ..... B41J 1/20

[52] U.S. Cl. ..... 400/74; 400/120; 346/76 PH

[58] Field of Search ..... 400/54, 74, 103, 120; 101/91; 346/76 PH; 219/482, 483, 484, 485, 486, 543

[56] References Cited

U.S. PATENT DOCUMENTS

| | | | |
|---|---|---|---|
| 4,399,208 | 7/1982 | Biedermann | 400/74 |
| 4,500,893 | 2/1985 | Sakura et al. | 346/76 PH |
| 4,573,058 | 2/1986 | Brooks | 400/120 |
| 4,587,411 | 5/1986 | Obstfelder et al. | 400/74 |
| 4,595,935 | 6/1986 | Brooks et al. | 400/54 |
| 4,673,303 | 6/1987 | Sansone et al. | 101/91 |
| 4,699,531 | 10/1987 | Vlinski, Sr. et al. | 400/74 |

FOREIGN PATENT DOCUMENTS

| | | | |
|---|---|---|---|
| 3022371 | 12/1981 | Fed. Rep. of Germany | 400/54 |
| 3149879 | 7/1982 | Japan | 400/120 |
| 148667 | 9/1982 | Japan | 400/74 |
| 199169 | 11/1983 | Japan | 400/54 |
| 139461 | 7/1985 | Japan | 400/74 |
| 183170 | 9/1985 | Japan | 400/74 |
| 244569 | 12/1985 | Japan | 400/74 |
| 19375 | 1/1986 | Japan | 400/54 |
| 123566 | 6/1986 | Japan | 400/54 |

*Primary Examiner*—David A. Wiecking
*Attorney, Agent, or Firm*—Shoemaker and Mattare

[57] ABSTRACT

A method and apparatus is described for checking the operation of a thermal dot printer during a printing cycle. When a pattern is to be printed a count of the number of printing elements intended to be operated in the cycle is stored. A signal indicative of the total current drawn from a supply by the operated printing elements is compared with the stored count. If the comparison indicates that all or a sufficient number of elements have been operated to effect printing, operation of the printing elements in further printing cycles is permitted otherwise further printing is inhibited. In an alternative method the printing elements are operated to print data in machine readable form and the data is read to produce a signal which is compared with data intended to be printed. The printing elements may print the data in a form for visual inspection and in machine readable form. The printer may form part of a franking machine in which the printed data is a franking of a mail item.

4 Claims, 2 Drawing Sheets

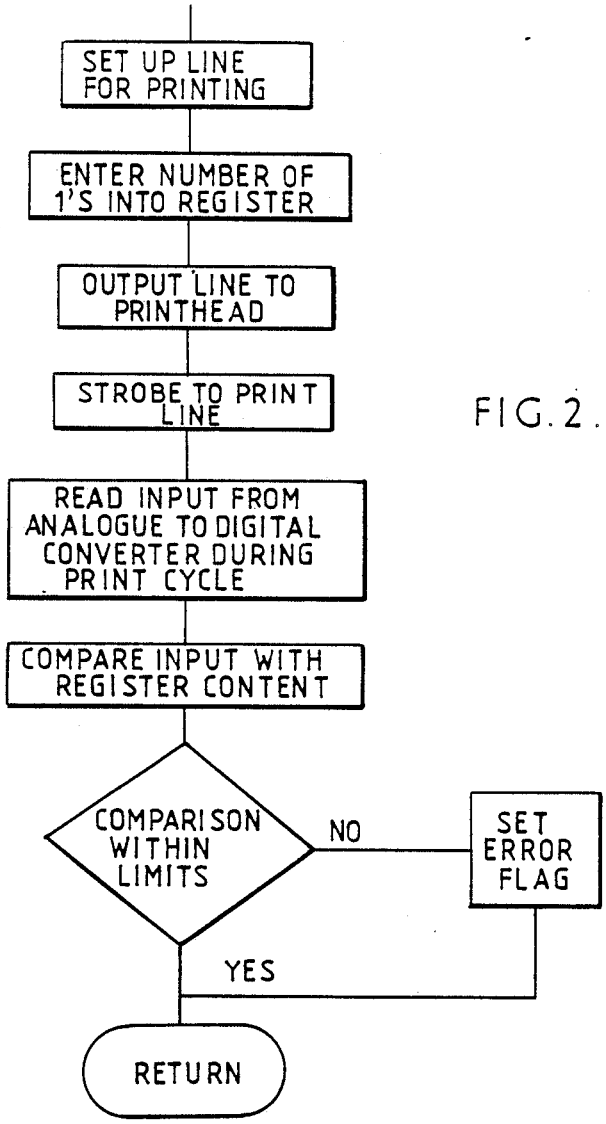
FIG. 2.
FIG. 4.
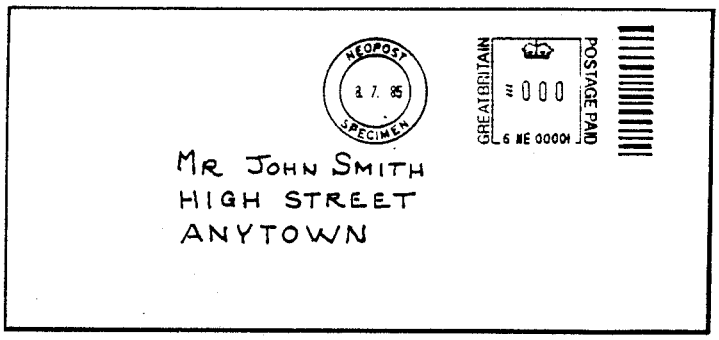

DEVICE FOR VERIFYING IF THERMAL PRINTER IS OPERATING CORRECTLY

BACKGROUND OF THE INVENTION

This invention relates to checking the operation of thermal printers and in particular to the checking of the operation of thermal printers when used in franking machines.

Franking machines print a franking on mails items in which the franking includes the value of postage and the date of franking and may include further data such as an identifier for the franking machine and coded data for checking the validity of the franking. It has been common in franking machines to use printing devices having print wheels which can be selectively positioned to print the required variable data and a print element to print the unchanging data. The print wheels are mechanically coupled to means for setting them to the desired printing position and in addition means are usually provided to sense the position of the wheels, prior to effecting the printing operation, so that there is no doubt that when the printing operation takes place the correct data will be printed. The construction of such printers is such that, provided an inking roller is present, a printing impression is assured upon operation of the device. Such printing devices require the manufacture and assembly of a large number of mechanical components and in addition, with the use of electronic data processing and display devices in franking machines, it is necessary to provide electro-mechanical interfaces between the electronic circuits and the mechanical components for setting the printing devices. Accordingly it is desirable to use printing devices which do not require movement of mechanical components to select the data to be printed. A convenient type of printing device to use in place of the mechanical printing devices is a thermally operated printing device using a thermal transfer process. In such printing devices, a print head has a plurality of selectively heatable print elements which bear against the rear face of a transfer ribbon carrying a layer of transferable ink on its front face. The ink is carried in a material which is melted in the region of a heated element of the print head whereby the melted material is transfered to the surface of an envelope held in contact with the front face of the ribbon. The elements of the print head are usually disposed in a line and by repeatedly selecting elements of the print head as the ribbon and envelope pass the print head a desired pattern is printed on the envelope. The selection of the elements of the print head is controlled for example by a microprocessor to print a desired pattern containing the required franking data. Although such printing devices have high reliability , there is no assurance ,as is the case with previously used mechanical printing devices, that all the selected printing elements have operated correctly and hence it is possible for a franking to be effected which is defective due to failure of one or more of the printing elements to heat to a temperature sufficient to cause transfer of ink from the ribbon to the envelope. A defective franking may be such as to be unacceptable to the postal authority while the accounting apparatus of the franking machine will have debited the cost of the franking to the user of the machine.

SUMMARY OF THE INVENTION

According to one aspect of the invention a thermal printing device includes a plurality of printing elements;

print selection means operable to select individual ones of said elements and to energise said selected elements to effect printing of a required print pattern; storage means to store data relating to said print pattern; sensing means responsive to operation of the print elements to generate data relating to the printing operation; means to compare the data relating to the print pattern and the data relating to the printing operation; and means operative in response to said comparison to inhibit further printing if the data relating to the printing operation differs by more than a predetermined limit from the data relating to the pattern.

The sensing means may be responsive to the magnitude of the sum of currents energising the selected printing elements and the the storage means may be operative to store data comprising the number of print elements selected to be energised by the print selection means.

Alternatively the sensing means may comprise reading means mounted adjacent the printing elements and responsive to a print pattern printed by the printing elements upon an article fed past the printing elements and the reading means.

The storage means may store data representing the print pattern and the comparison means compares the stored data representing the print pattern with the response of the reading means to the printed pattern.

A thermal printing device as hereinbefore defined may be incorporated in a franking machine. An accounting function of the franking machine may be inhibited when the comparison indicates that the data relating to the printing operation differs by more than a predetermined limit from the data relating to the pattern.

According to another aspect of the invention a method of checking the operation of a thermal printing device during a printing cycle in which printing of a desired pattern is effected by selectively operating a plurality of printing elements includes the steps of storing data relating to a required pattern to be printed; energising those elements of the plurality required to print the pattern; deriving print data from operation of those energised elements; comparing said data relating to the required pattern with said print data and inhibiting further operation of the print elements in the event that said print data differs by more than a predetermined limit from said data relating to the required pattern.

According to a further aspect of the invention a method of checking the operation of a thermal dot printer in a franking machine for printing a value of franking on a mail in which the franking value is set into a register comprises the steps of storing a first signals representing those dot print elements selected from a plurality of dot print elements required to be operated to print at least a portion of said franking on said mail item; deriving a second signal indicative of the number of print elements to be operated to print said portion of franking; utilising said first signals to operate the selected printing elements; deriving a third signal indicative of the number of print elements actually operated in printing said portion of franking; and inhibiting further operation of said print elements if said second and third signals differ by more than a predetermined limit.

According to another aspect of the invention a method of checking the operation of a thermal dot printer in a franking machine for printing a value of franking on a mail item in which the franking value is set into a register comprise the steps of generating signals to operate a number of dot print elements selected from a plurality of dot print elements to print the franking value on a mail item; deriving a signal, indicative of the franking value, from the franking value printed on the mail item and comparing said signal with said value set in the register to inhibit further operation of the printer if said signal is not indicative of the value set in the register.

BRIEF DESCRIPTION OF THE DRAWINGS

Embodiments of the invention will now be described with reference by way of example to the drawings in which:

FIG. 2 is a flow chart of the operation of the arrangement shown in FIG. 1;

FIG. 4 illustrates a mail item bearing a print pattern and a franking impression for checking by the arrangement shown in FIG. 3.

DESCRIPTION OF THE PREFERRED EMBODIMENTS

Figure 1:
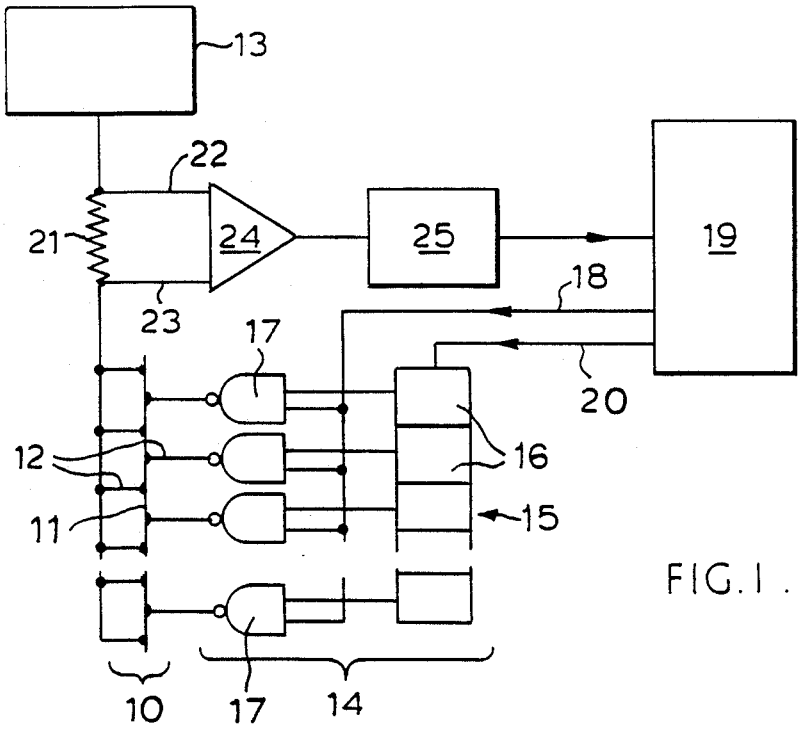
FIG. 1 is a block diagram of a thermal printing device incorporating means for checking the operation thereof.

Referring first to FIG. 1 of the drawings, a thermal print head 10 comprises a strip 11 of electrically resistive material having a plurality of connections 12 spaced along its length to operationally divide the strip into a plurality of printing elements. Alternate ones of these connections are connected to a power supply 13 and the other connections are connected to the outputs of a selection circuit 14. The selection circuit 14 may comprise a shift register 15 having a plurality of stages 16 corresponding to the printing elements of the print head 10 and a like plurality of logic gates 17. The logic gates are NAND gates with two inputs. One input is connected to the corresponding stage 16 of the shift register 15 and the other input of all the gates are connected in common to receive a strobe signal on line 18. An element of the print head 10 is selected by writing a binary '1' into the corresponding stage 16 of the shift register 15 so that one input of the corresponding logic gate 17 goes high. When the other input of the gate 17 is driven high by a strobe pulse on line 18, the output of the NAND gate is held low and current from the power supply flows through the selected print head element and results in heating of that element. Operation of the print head is controlled by a microprocessor 19 which outputs data signals on line 20 to set the stages 16 of the shift register 15 in accordance with a line of printing which it is desired to effect and which outputs a strobe pulse on line 18 to initiate the printing operation. The printing head 10 allows printing of a line of dots in the direction of the length of the strip 11. By causing relative movement between an envelope and the print head and energising the print head in a sequence of print cycles it will be appreciated that a complete franking pattern will be printed by selection of appropriate print elements in each of the cycles. Means are provided for feeding an envelope past the print head at a substantially uniform speed and also for feeding a transfer ribbon between the print head and the envelope at the same speed as the envelope so that the ribbon and envelope have no relative motion as they pass the print head. Such means are known for thermal transfer printers and therefore it is believed to be unnecessary to describe such means herein.

In order to check that the thermal printing head has operated correctly, the magnitude of the current drawn by the print head from the power supply 13 is sensed for each printing operation. This sensing is carried out by providing a resistor 21 in the connection between the print head and the power supply. Inputs 22,23 of a differential amplifier 24 are connected across the sensing resistor 21 and the output of amplifier 24 is connected through an analogue to digital converter 25 to an input port of the microprocessor 19. The current flow from the power supply through the resistor 21 to the print head strip 11 produces a voltage difference across the resistor which is amplified by amplifier 24. The analogue output of the amplifier is converted to a digital signal representing the magnitude of current flow through the resistor 21 and this digital signal is input to the microprocessor 19. The magnitude of the current drawn by the strip 11 of the print head is proportional to the number of print head elements which have been energised.

The flow chart of FIG. 2 illustrates the manner in which the microprocessor utilises the digital signal obtained from the sensing resistor 21 to check that the current drawn by the strip 11 corresponds to the current which should be drawn if all the selected elements have been energised. Firstly, data for a line of printing is set up in a register of the microprocessor. This data consists of a binary string in which each print element intended to be energised is represented by a binary '1' and each element which is not to be energised is represented by a binary '0'. The number of binary '1''s is counted and stored in a register or counter. The data for the line of printing is output on line 20 to the selection circuit 14 of the print head. Printing is initiated by a strobe signal on line 18 to cause current to flow through the selected printing elements of the print head. During this flow of current the microprocessor reads the input obtained from the analogue to digital converter 25, which as explained above represents the total current drawn by the print head strip 11. The value of this digital input is compared with the number of binary '1''s stored earlier in the print cycle. If the result of the comparison is within predetermined limits the microprocessor returns to the start again and sets up the next line of printing. If the result of the comparison is outside the predetermined limits an error flag is set. Setting of the error flag may be used to inhibit further printing immediately or if desired further printing cycles may be carried out to attempt to print further lines of the franking and if the error flag is set during more than a predetermined number of cycles further printing is inhibited. Inhibition of printing will prevent further use of the franking machine until operation of the print head has been checked and will inhibit debiting of the value of the current franking by the accounting operation of the franking machine. It will be appreciated that the printing effected by the print head is in the form of a plurality of dots. These dots are relatively small and closely spaced so that in the case of a franking impression failure of a single element at any one position is unlikely to cause any substantial loss in clarity of the printed data. However failure of a larger number of elements particularly if they are adjacent elements could result in total loss of printing of a character or row of characters. Thus in general strict equality in the comparison between the number of binary '1''s stored and the current value is not essential and it is sufficient that the deviation is not too large. While it is believed to be unnecessary to describe in detail the operation of the accounting function of the franking machine, reference may be had to U.S. Pat. No. 4,481,604 for disclosure of apparatus and its operation for carrying out accounting functions in a franking machine.

Figure 3:
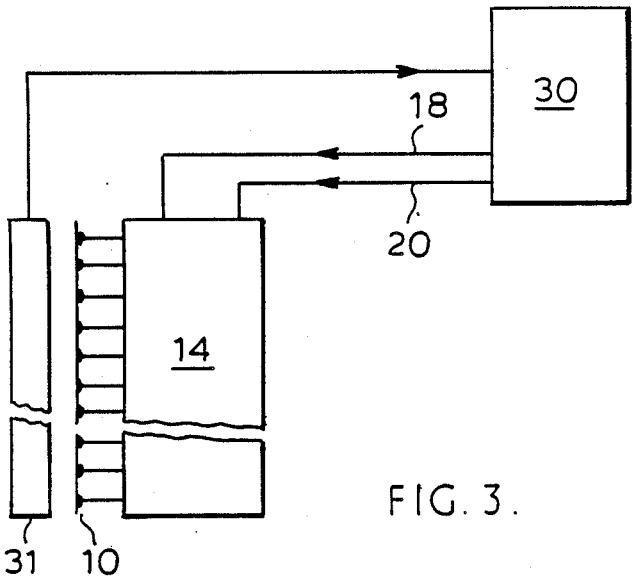
FIG. 3 is a block diagram of an alternative arrangement for checking the operation of a thermal printing device.

In an alternative embodiment shown in FIG. 3, the print head is controlled to print not only the required franking but also a pattern which is sensed by reading means to determine whether all, or sufficient, of the printing elements are operationally functional. The thermal print head and selection circuit are as shown in FIG. 1 and have been given the same references. The operation of the print head is controlled by a microprocessor 30 as previously described. Immediately adjacent the print head 10, in a downstream direction relative to the feeding of the mail items past the print head, there is provided a pattern recognition device 31.

In operation, the print head is controlled to print a franking on an envelope as described above and, in addition, to print a machine readable pattern on the envelope adjacent the franking. Thus, feeding of the envelope past the print head to effect printing also causes the printed pattern to be fed past the reading means. Data relating to the printing of the pattern is stored by the microprocessor and upon reading of the pattern by the reading device the output of the reading device 31 is input to the microprocessor 30. The microprocessor is programmed to compare this output with the stored data corresponding to the pattern intended to be printed. If the results of this comparison indicate that more than an acceptable number of printing elements are non-functional or that a group of adjacent elements are non-functional the microprocessor sets an error flag and inhibits further printing operations.

The pattern may be an invariable pattern of such form as to cause every element of the print head, or a sufficient number of elements distributed along the print head strip 11, to be utilised in printing the pattern. Alternatively, the pattern may be variable and may consist of useful data. A preferred form of pattern is a pattern of bars. These bars would be printed by selecting a group of printing elements corresponding to the desired bar pattern and repeatedly energising the selected group in a number of cycles. If desired, in order to check operation of other print elements, the position of the bars may be changed cyclically, for example, either during the printing on each mail item or during printing of a number of mail items. The bars may be of different thickness and where it is desired to represent useful data the bars may form a so-called bar code. The useful data represented by the bar code may include for example the postage value. When this is read by the reader 31 and a comparison of this value read from the bar code with the value entered into the franking machine confirms that the read value is correct, the accounting sequence in the franking machine is initiated. The inclusion of the postage value in the bar code would enable verification of the postage value charged to the user should there be any failure in the printing of the franking impression. The pattern may be printed spaced from the normal franking impression or may be combined with the franking impression. However it is preferred that the pattern portion of the printing in either case is printed subsequently to the printing of critical franking data such as the franking value so that if printing elements selected to print the franking value have not functioned correctly, such mal-function will be detected by the reading device prior to ejection of the envelope from the franking machine.

We claim:

1. A thermal printing device including:

a plurality of printing elements selectively heatable by passage of electric current therethrough;

storage means operable to store a plurality of print signals representing a pattern to be printed in a print cycle and corresponding to those printing elements selected to be heated in said print cycle;

control means operable to generate a print strobe signal;

switch means responsive to said stored print signals representing said pattern and to said print strobe signal to pass electric current through said selected printing elements to effect printing of said pattern;

means responsive to the sum of electric currents through said selected printing elements in the print cycle to generate an output signal representing the number of printing elements heated in that print cycle;

comparison means operative in response to the number of said print signals stored in said storage means and to said output signal representing the number of heated printing elements to generate an error signal when the output signal differs by more than a predetermined limit from the print signals.

2. A franking machine including a thermal printing device comprising:

a plurality of printing elements selectively operable by passage of electric current therethrough to cause heating thereof;

control means operable during a print cycle to store a plurality of print signals representing at least a part of a franking impression to be printed on a mail item and corresponding respectively to those selected ones of the printing elements to be heated to effect printing of said part of the franking impression during the print cycle; said control means being operative to store print data relating to said print signals; said control means being operative to cause passage of electric current through the selected ones of said printing elements to effect heating thereof during the print cycle to print said part of the franking impression on the mail item;

monitor means operative to generate a monitor signal indicative of operation of said selected printing elements; and said control means being operative in response to said print data and to said monitor signal to initiate a succeeding print cycle when the monitor signal and the print data differ by less than a predetermined limit and to generate an error signal when the monitor signal differs by more than the predetermined level from said print data.

3. A franking machine including a plurality of printing elements selectively operable by passage of electric current therethrough to cause heating thereof:

means operable to store a binary signal representing at least a portion of a franking impression including a value of franking; said binary signal comprising binary digits of a first value corresponding to printing elements required to be operated to print said portion of a franking impression during a print cycle;

control means operative in response to said binary signal to store a digital count of the number of binary digits of said first value in said binary signal;

print control means operative in response to said binary signal to enable operation of those ones of the printing elements corresponding to binary digits of said first value during the print cycle;

monitor means responsive to the sum of electric currents passed through the plurality of printing elements in the print cycle to generate a digital signal representing the number of printing elements operated in said print cycle; and said control means being operative to compare the digital count with said digital signal and to initiate a next succeeding print cycle when any difference between the digital count and said digital signal has a first value within a predetermined limit and to generate a print error flag when the difference between the digital count and said digital signal has a second value greater than said first value.

4. A method of checking the operation during a print cycle of a plurality of thermal printing elements of a postal franking machine operable to print a franking impression incorporating a value of franking on a mail item comprising the steps of:

entering into storage means a string of binary digits corresponding to the plurality of printing elements, digits of a first binary value representing parts of the franking impression to be printed in a print cycle by operation of selected ones of said printing elements and digits of a second binary value representing printing elements which are to be inoperative during the print cycle;

storing a count value equal to the number of binary digits of said first binary value;

utilizing said stored string of binary digits to operate said selected ones of the printing elements by passage of electric current therethrough to cause heating thereof to effect printing of said parts of the franking impression;

generating an analogue signal representing the sum of currents passing through the plurality of printing elements during the print cycle;

converting the analogue signal to a digital value representing the number of printing elements of the plurality which operated during the print cycle;

comparing the count value with the digital value and in response to the count value and digital value having a first difference less than a predetermined value initiating a next succeeding print cycle and in response to the count value and digital value having a second difference greater than said first difference generating an error signal.

* * * * *